US009099030B2

(12) United States Patent
Kim et al.

(10) Patent No.: US 9,099,030 B2
(45) Date of Patent: Aug. 4, 2015

(54) DISPLAY DEVICE

(71) Applicant: Samsung Display Co., Ltd., Yongin, Gyeonggi-Do (KR)

(72) Inventors: Ilgon Kim, Seoul (KR); Kyung-Hoon Kim, Uiwang-si (KR); Seon Young Choi, Gunpo-si (KR); Jangmi Kang, Bucheon-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 186 days.

(21) Appl. No.: 13/721,980

(22) Filed: Dec. 20, 2012

(65) Prior Publication Data

US 2013/0307758 A1 Nov. 21, 2013

(30) Foreign Application Priority Data

May 18, 2012 (KR) ..... 10-2012-0053295

(51) Int. Cl.
*G09G 3/22* (2006.01)
*G09G 3/36* (2006.01)

(52) U.S. Cl.
CPC ..... *G09G 3/22* (2013.01); *G09G 3/3648* (2013.01); *G09G 3/3677* (2013.01); *G09G 2300/0426* (2013.01); *G09G 2310/0281* (2013.01); *Y10T 29/49002* (2015.01)

(58) Field of Classification Search
CPC . G09G 3/3688; G09G 3/3677; G09G 3/3648; G09G 3/20; G09G 3/36; G09G 3/22; G09G 2310/0281; G09G 2300/0426
See application file for complete search history.

(56) References Cited

U.S. PATENT DOCUMENTS

| | | | | |
|---|---|---|---|---|
| 6,380,919 | B1 | 4/2002 | Koyama et al. | |
| 8,643,632 | B2 * | 2/2014 | Han et al. | 345/204 |
| 2005/0146490 | A1 | 7/2005 | Kang et al. | |
| 2006/0267909 | A1 * | 11/2006 | Hsu et al. | 345/100 |
| 2007/0046607 | A1 * | 3/2007 | Lai | 345/92 |
| 2007/0279363 | A1 | 12/2007 | Maeng et al. | |
| 2008/0068358 | A1 * | 3/2008 | Lee et al. | 345/204 |
| 2008/0129717 | A1 * | 6/2008 | Lee et al. | 345/204 |
| 2008/0278467 | A1 * | 11/2008 | Hwang et al. | 345/205 |
| 2009/0174642 | A1 | 7/2009 | Min et al. | |
| 2009/0184945 | A1 | 7/2009 | Sasaki et al. | |
| 2011/0164017 | A1 | 7/2011 | Chung | |

FOREIGN PATENT DOCUMENTS

| | | | |
|---|---|---|---|
| JP | 6347752 | A | 12/1994 |
| JP | 2006048074 | A | 2/2006 |
| JP | 2008033107 | A | 2/2008 |
| JP | 2008242144 | A | 10/2008 |
| KR | 1020020056706 | A | 7/2002 |
| KR | 1020060028879 | A | 4/2006 |
| KR | 1020080013417 | A | 2/2008 |
| KR | 1020110137591 | A | 12/2011 |

* cited by examiner

*Primary Examiner* — Jonathan Boyd
*Assistant Examiner* — Sardis Azongha
(74) *Attorney, Agent, or Firm* — Cantor Colburn LLP

(57) ABSTRACT

A display device includes a plurality of gate lines extending in a first direction, a plurality of data lines extending in a second direction, a plurality of sub-gate lines corresponding to the plurality of gate lines and extending in a first direction to be adjacent to a corresponding gate line of the plurality of gate lines, a gate driver configured to drive the plurality of gate lines, a data driver configured to drive the plurality of data lines, and a plurality of pixels arranged in a display area, where an end of each of the plurality of gate lines extends in the first direction from the gate driver is electrically connected to a center portion of a corresponding sub-gate line in the first direction.

13 Claims, 13 Drawing Sheets

DISPLAY DEVICE

This application claims priority to Korean Patent Application No. 10-2012-0053295, filed on May 18, 2012, and all the benefits accruing therefrom under 35 U.S.C. §119, the content of which in its entirety is herein incorporated by reference.

BACKGROUND

1. Field

Exemplary embodiments of the invention relates to a display device.

2. Description of the Related Art

In recent, various types of flat panel display devices, such as a liquid crystal display, a field emission display, a plasma display panel, an organic electroluminescence display device, for example, have been developed.

The flat panel display devices are applied to appliances, such as a television set and a computer monitor, for example, to display various images, e.g., a motion picture and a text. Particularly, an active matrix type liquid crystal display that drives liquid crystal cells using thin film transistors has been widely used due to the characteristic thereof, e.g., superior display quality and low power consumption, and tends to have a very large size and a high resolution.

Where the flat panel display devices become large in size and high in resolution, deterioration of the display quality may occur. In addition, the size of a bezel may increase when the flat panel display devices become large in size and high in resolution.

SUMMARY

An exemplary embodiment of the invention is related to a display device including a plurality of gate lines extending in a first direction, a plurality of data lines extending in a second direction, a plurality of sub-gate lines corresponding to the plurality of gate lines and extending in a first direction to be adjacent to a corresponding gate line of the plurality of gate lines, a gate driver configured to drive the plurality of gate lines, a data driver configured to drive the plurality of data lines, and a plurality of pixels arranged in a display area. In such an embodiment, an end of each of the plurality of gate lines extends in the first direction from the gate driver and is electrically connected to a center portion of a corresponding sub-gate line in the first direction.

According to one or more exemplary embodiments, the signal delay times between the gate lines adjacent to each other are substantially the same as each other, and thus a horizontal line defect is effectively prevented from occurring on the display panel to which an interlaced driving scheme is applied.

In one or more exemplary embodiments, in the display device having a narrow bezel and including the gate and data drivers disposed at an upper end portion of the display panel, although two or more gate lines are simultaneously driven, deterioration in the display quality, which is caused by the transmission time delay between the gate lines adjacent to each other, is effectively prevented.

BRIEF DESCRIPTION OF THE DRAWINGS

The above and other features of the invention will become readily apparent by reference to the following detailed description when considered in conjunction with the accompanying drawings wherein.

DETAILED DESCRIPTION

Figure 1:
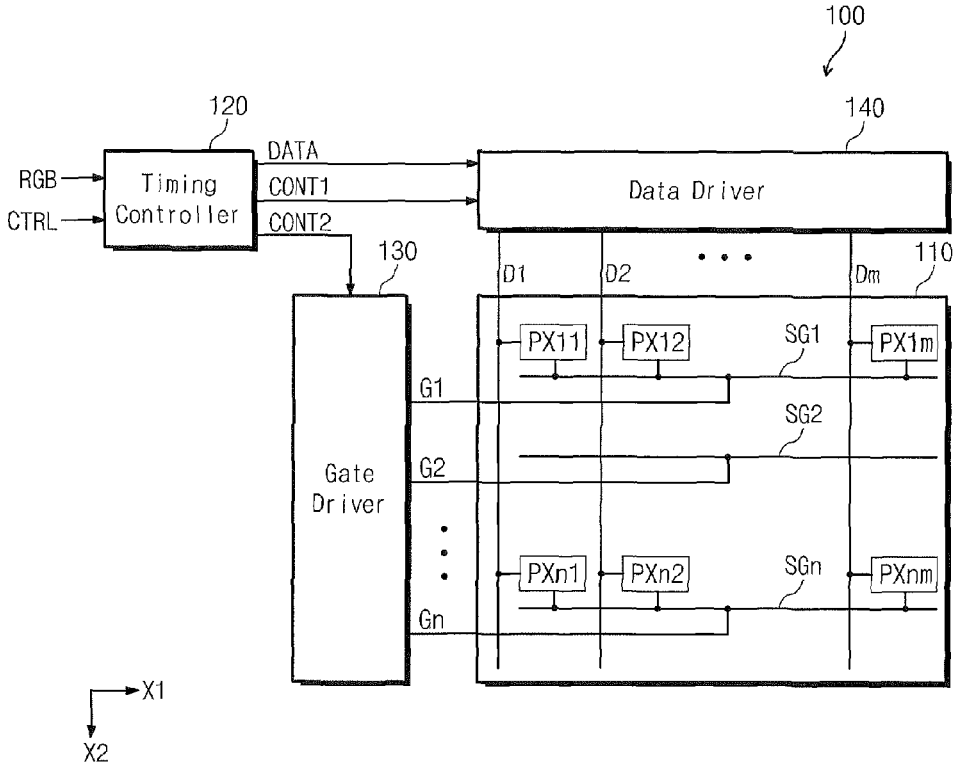
FIG. 1 is a block diagram showing an exemplary embodiment of a display device according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

Hereinafter, exemplary embodiments of the invention will be described in detail with reference to the accompanying drawings.

FIG. 1 is a block diagram showing an exemplary embodiment of a display device according to the invention.

Referring to FIG. 1, a display device 100 includes a display panel 110, a timing controller 120, a gate driver 130 and a data driver 140.

The display panel 110 displays an image. The display panel 110 may include a liquid crystal display panel, an organic light emitting display panel, an electrophoretic display panel and an electrowetting display panel, for example, but not being limited thereto. Hereinafter, an exemplary embodiment, where the display panel 100 is a liquid crystal display panel, will be described for convenience of description.

The display panel 110 includes a plurality of gate lines, e.g., a first gate line G1 to an n-th gate line Gn, extending in a first direction X1, a plurality of sub-gate lines, e.g., a first sub-gate line SG1 to an n-th sub-gate line SGn, a plurality of data lines, e.g., a first data line D1 to an m-th data line Dm, extending in a second direction X2, and a plurality of pixels PX11 to PXnm arranged substantially in a matrix form and connected to the data lines D1 to Dm and the sub-gate lines SG1 to SGn. The data lines D1 to Dm are insulated from the gate lines G1 to Gn and from the sub-gate lines SG1 to SGn.

In an exemplary embodiment, as shown in FIG. 1, each of the gate lines G1 to Gn is disposed adjacent to a corresponding sub-gate line of the sub-gate lines SG1 to SGn. In such an embodiment, an end of each of the gate lines G1 to Gn is electrically connected to a center portion of the corresponding sub-gate line of the sub-gate lines SG1 to SGn in the first direction X1 and the other end of each of the gate lines G1 to Gn is connected to the gate driver 130. In one exemplary embodiment, for example, the first gate line G1 is electrically connected to the first sub-gate line SG1, the second gate line G2 is electrically connected to the second sub-gate line SG2, and the n-th gate line Gn is electrically connected to the n-th sub-gate line SGn. The configuration of the display panel 110 will be described later in greater detail.

The timing controller 120 receives image signals RGB and control signals CTRL, such as a vertical synchronization signal, a horizontal synchronization signal, a main clock signal and a data enable signal, for example, from an external source (not shown). The timing controller 120 converts the image signals RGB to image data DATA corresponding to an operating condition of the display panel 110 based on the control signals CTRL. The timing controller 120 applies the image data DATA and a first control signal CONT1 to the data driver 140 and applies a second control signal CONT2 to the gate driver 130. The first control signal CONT1 includes a horizontal synchronization start signal, a clock signal and a line latch signal, for example, and the second control signal CONT2 includes a vertical synchronization start signal, an output enable signal, a gate pulse signal and a dummy enable signal, for example.

The gate driver 130 drives the gate lines G1 to Gn in response to the second control signal CONT2 from the timing controller 120. The gate driver 130 includes gate driver integrated circuits ("IC"s). In an exemplary embodiment, the gate driver ICs may be fabricated with an amorphous semiconductor, a crystalline semiconductor or a polycrystalline semiconductor, for example.

The data driver 140 drives the data lines D1 to Dm in response to the data signal DATA and the first control signal CONT1 from the timing controller 120.

Figure 2:
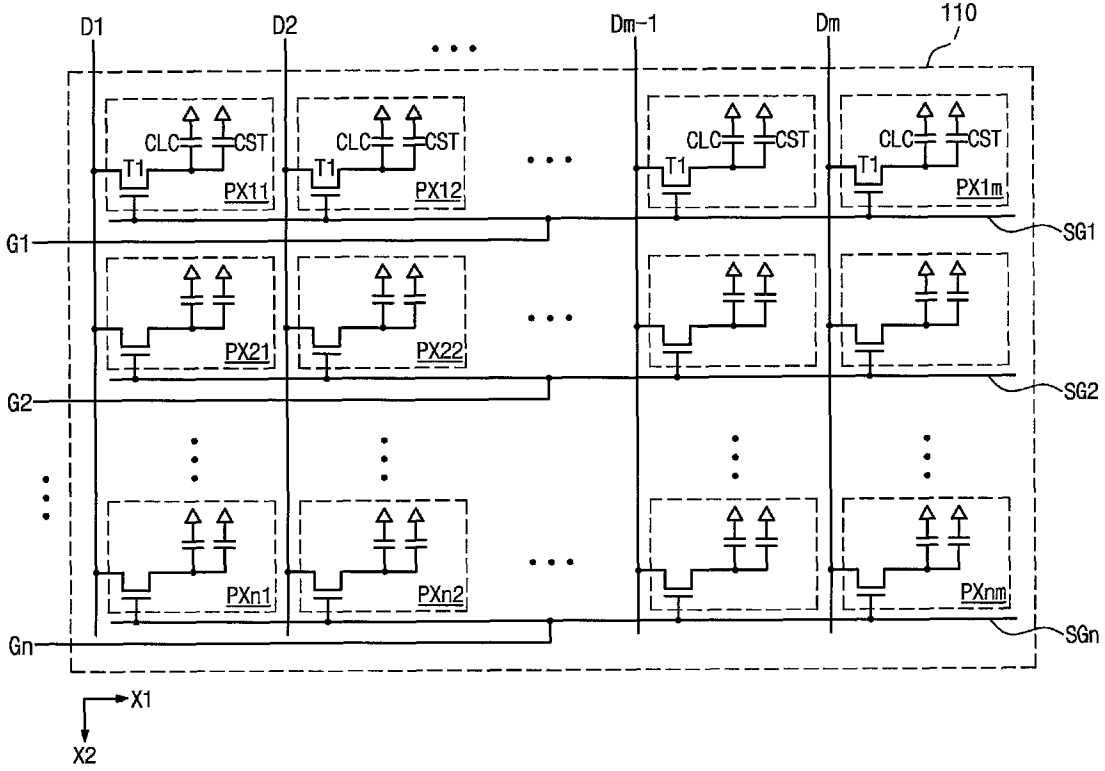
FIG. 2 is a circuit diagram showing an exemplary embodiment of a circuit configuration of the display panel shown in FIG. 1.

FIG. 2 is a circuit diagram showing an exemplary embodiment of a circuit configuration of the display panel shown in FIG. 1.

Referring to FIG. 2, the pixels PX11 to PXnm are arranged in the display panel 110. The display panel 110 may be, but not limited to, a glass substrate, a silicon substrate, or a film substrate, for example. The data lines D1 to Dm are spaced apart from each other at a substantially constant interval and extending in the second direction X2, and the gate lines G1 to Gn are spaced apart from each other at a substantially constant interval and extending in the first direction X1. The sub-gate lines SG1 to SGn correspond to the gate lines G1 to Gn, and each of the sub-gate lines SG1 to SGn is disposed adjacent to the corresponding gate line of the gate lines G1 to Gn. The end of each of the gate lines G1 to Gn is electrically connected to the center portion of the corresponding sub-gate line of the sub-gate lines SG1 to SGn in the first direction X1.

In an exemplary embodiment, the pixels PX11 to PXnm are arranged in areas defined by the sub-gate lines SG1 to SGn crossing the data lines D1 to Dm in the matrix form.

A gate driving signal provided from the gate driver 130 shown in FIG. 1 is applied to the pixels PX11 to PXnm through the gate lines G1 to Gn and the sub-gate lines SG1 to SGn. The gate driving signal applied to the pixels adjacent to each other in the second direction X2 has substantially the same delay time. In such an embodiment, the gate driving signal applied to the pixel PX11 has substantially the same delay time as the delay time of the gate driving signal applied to the pixel PX21 adjacent to the pixel PX11 in the second direction X2.

Figure 3:
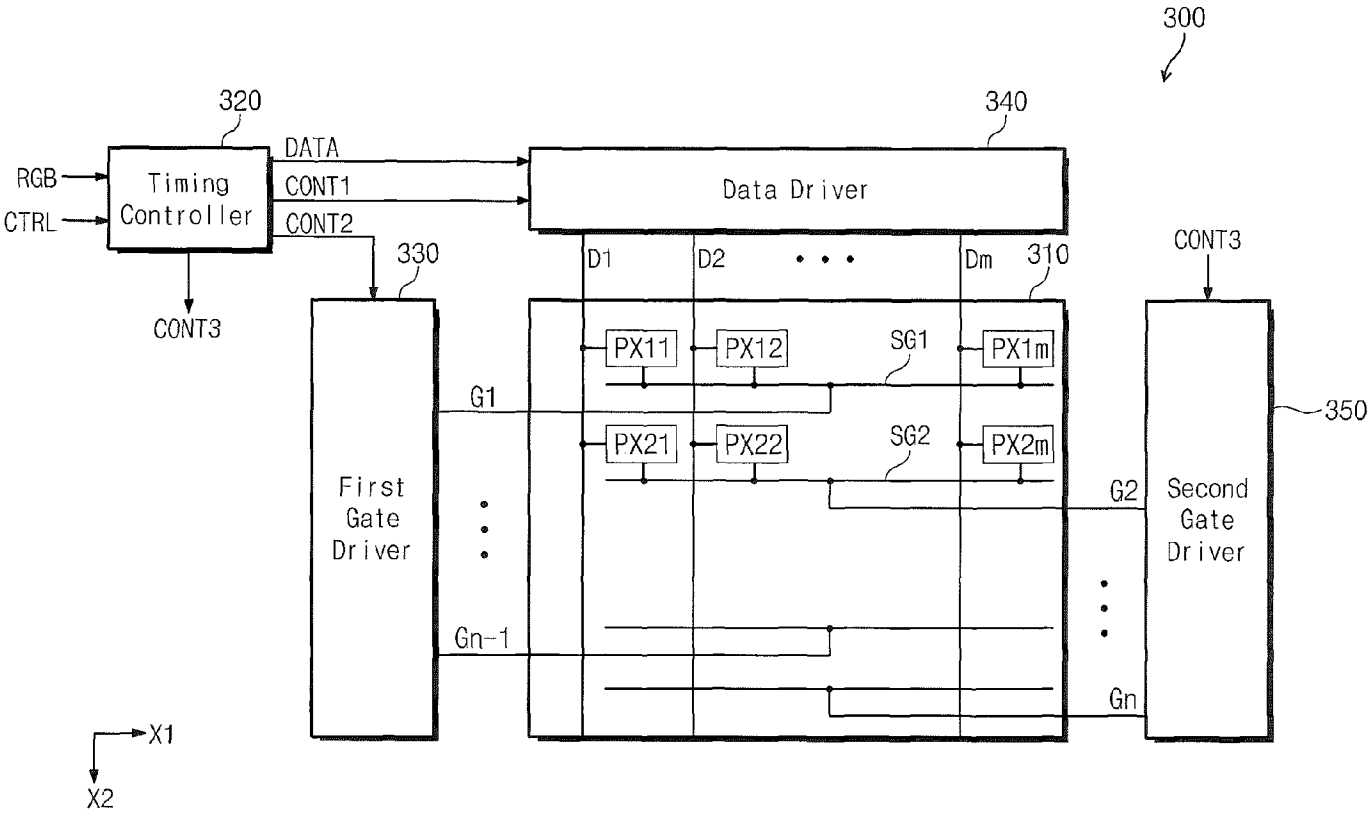
FIG. 3 is a block diagram showing an alternative exemplary embodiment of a display device according to the invention.

FIG. 3 is a block diagram showing an alternative exemplary embodiment of a display device according to the invention.

Referring to FIG. 3, a display device 300 includes a display panel 310, a timing controller 320, first and second gate drivers 330 and 350 and a data driver 340.

The display panel 310 includes a plurality of gate lines G1 to Gn extending in a first direction X1, a plurality of sub-gate lines SG1 to SGn, a plurality of data lines D1 to Dm extending in a second direction X2, and a plurality of pixels PX11 to PXnm arranged in areas defined by the data lines D1 to Dm crossing the sub-gate lines SG1 to SGn substantially in a matrix form. The data lines D1 to Dm are insulated from the gate lines G1 to Gn and from the sub-gate lines SG1 to SGn.

In an exemplary embodiment, each of the gate lines G1 to Gn is disposed adjacent to a corresponding sub-gate line of the sub-gate lines SG1 to SGn. In such an embodiment, an end of each of the gate lines G1 to Gn is electrically connected to a center portion of the corresponding sub-gate line of the sub-gate lines SG1 to SGn in the first direction X1 and the other end of each of the gate lines G1 to Gn is connected to the first and second gate drivers 330 and 350. In an exemplary embodiment, as shown in FIG. 3, the other end of odd-numbered gate lines G1, G3, . . . , Gn-1 of the gate lines G1 to Gn is connected to the first gate driver 330 and the other end of even-numbered gate lines G2, G4, . . . , Gn of the gate lines G1 to Gn is connected to the second gate driver 350. In such an embodiment, the end of the gate line G1 is electrically connected to the sub-gate line SG1 and the other end of the gate line G1 is connected to the first gate driver 330. The end of the gate line G2 is electrically connected to the sub-gate line SG2 and the other end of the gate line G2 is connected to the second gate driver 350. The end of the gate line Gn-1 is electrically connected to the sub-gate line SGn-1 and the other end of the gate line Gn-1 is connected to the first gate driver 330. The end of the gate line Gn is electrically connected to the sub-gate line SGn and the other end of the gate line Gn is connected to the second gate driver 350.

The timing controller 320 receives image signals RGB and control signals CTRL from an external source (not shown). The timing controller 320 converts the image signals RGB to image data DATA corresponding to an operating condition of the display panel 310 based on the control signals CTRL. The timing controller 320 applies the image data DATA and a first control signal CONT1 to the data driver 340, applies a second control signal CONT2 to the first gate driver 330, and applied a third control signal CONT3 to the second gate driver 350. The first control signal CONT1 includes a horizontal synchronization start signal, a clock signal and a line latch signal, for example, and the second and third control signals CONT2 and CONT3 include a vertical synchronization start signal, an output enable signal, a gate pulse signal and a dummy enable signal, for example. The second and third control signals CONT2 and CONT3 control the first and second gate drivers 330 and 350 such that the gate lines G1 to Gn are sequentially driven.

The first gate driver 330 and the second gate driver 350 are disposed at opposing sides of the display panel 310, in which the pixels PX11 to PXnm are arranged, respectively, such that the first and second drivers 330 and 350 face each other.

The first gate driver 330 drives the odd-numbered gate lines G1, G3, . . . , Gn-1 in response to the second control signal CONT2 from the timing controller 320. The second gate driver 350 drives the even-numbered gate lines G2, G4, . . . , Gn in response to the third control signal CONT3 from the timing controller 320.

Each of the first and second gate drivers 330 and 350 includes gate driver ICs. The gate driver ICs may be fabricated with an oxide semiconductor, an amorphous semiconductor, a crystalline semiconductor or a polycrystalline semiconductor, for example, but not being limited thereto.

The gate lines G1 to Gn are sequentially driven by the first gate driver 330 and the second gate driver 350. In an exemplary embodiment, the gate line G1 is driven by the first gate driver 330, and then the gate line G2 is driven by the second gate driver 350. In such an embodiment, the gate line G4 is driven by the second gate driver 350 after the gate line G3 is driven by the first gate driver 330. The gate lines G1 to Gn may be sequentially driven through the above-mentioned driving scheme. The driving scheme that the gate lines G1 to Gn are sequentially driven by the first and second gate drivers 330 and 350 will be referred to as an interlaced driving scheme.

The data driver 340 drives the data lines D1 to Dm in response to the data signal DATA and the first control signal CONT1 from the timing controller 320.

In an exemplary embodiment, where the size of the display device 300 is substantially large, a length of the gate lines G1 to Gn, through which the gate driving signal is transmitted, are substantially lengthened. When the gate lines G1 to Gn are substantially lengthened, a transmission time delay of the gate driving signal may occur. In a display device, where the gate lines G1 to Gn are directly connected to the pixels PX11 to PXnm, the delay time of the gate driving signal applied to the pixels PX11 and PX2m, which are disposed adjacent to the first and second gate drivers 330 and 350, respectively, is substantially different from the delay time of the gate driving signal applied to the pixels PX1m and PX21, which are disposed at a long distance from the first and second gate drivers 330 and 350, respectively. When gray-scale voltages, which correspond to the same image data DATA, are applied to the pixels PX11 to PXnm through the data lines D1 to Dm, charge times of the pixels PX11 and PX21 are different from each other by the transmission time delay of the gate driving signal applied to the pixels PX11 and PX21 adjacent to each other in the second direction X2 such that a viewer may recognize a horizontal line defect on the display panel 310.

In an exemplary embodiment of the display device 300, as shown in FIG. 3, the first gate line G1 is electrically connected to the center portion of the first sub-gate line SG1 in the first direction X1 and the second gate line G2 is electrically connected to the center portion of the second sub-gate line SG2 in the first direction X1. In such an embodiment, the transmission time delay when the gate driving signal output from the first gate driver 330 is applied to the pixel PX11 through the first gate line G1 and the first sub-gate line SG1 may be substantially the same as the transmission time delay when the gate driving signal output from the second gate driver 350 is applied to the pixel PX21 through the second gate line G2 and the second sub-gate line SG2. Thus, the horizontal line defect is effectively prevented from occurring on the display apparatus 300 to which the interlaced driving scheme utilizing the first and second gate drivers 330 and 350 is applied.

Figure 4:
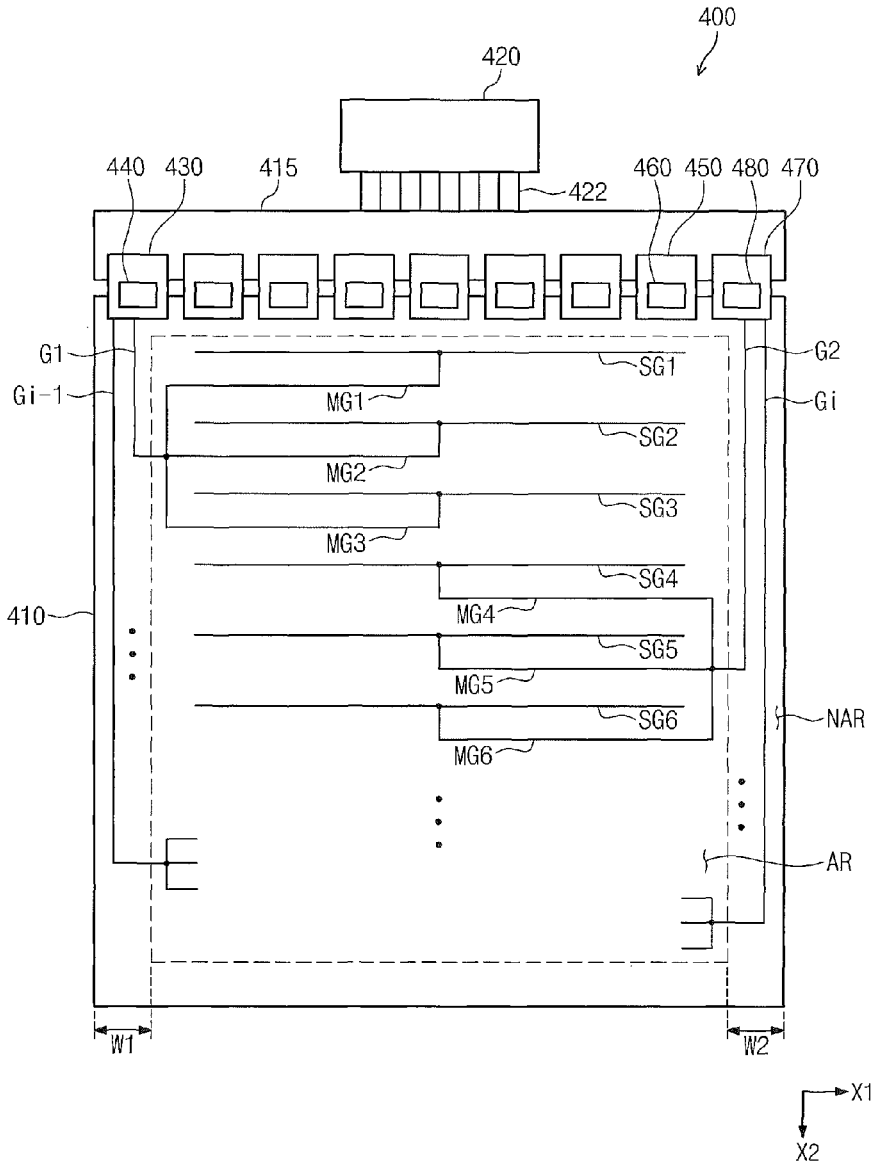
FIG. 4 is a block diagram showing a display device according to another exemplary embodiment of the invention.

FIG. 4 is a block diagram showing another alternative exemplary embodiment of a display device according to the invention.

Referring to FIG. 4, a display device 400 includes a display panel 410, a circuit board 415, a timing controller 420, first and second gate driving circuits 430 and 470 and a plurality of data driving circuits 450.

The display panel 410 includes a display area AR, in which a plurality of pixels is arranged, and a non-display area NAR disposed adjacent to the display area AR. The image is displayed in the display area AR and not displayed in the non-display area NAR. In an exemplary embodiment, the display panel 410 may be a glass substrate, a silicon substrate or a film substrate, but not being limited thereto.

The circuit board 415 includes various circuits to drive the display panel 410. The circuit board 415 includes electrical wires connected to the timing controller 420 and the first and second gate driving circuits 430 and 470.

The timing controller 420 is electrically connected to the circuit board 415 through a cable 422. The timing controller 420 applies image data DATA and a first control signal CONT1 to the data driving circuit 420, applies a second control signal CONT2 to the first gate driving circuit 430, and applies a third control signal CONT3 to the second gate driving circuit 470. The first control signal CONT1 includes a horizontal synchronization start signal, a clock signal and a line latch signal, for example, and the second control signal CONT2 includes a vertical synchronization start signal, an output enable signal, a gate pulse signal and a dummy enable signal, for example.

In an exemplary embodiment, each of the data driving circuits 450 may be in a form of a tape carrier package ("TCP") or a chip-on-film ("COF"), and a data driver integrated circuit 460 is mounted on each of the data driving circuits 450. Each of the data driver integrated circuits 460 drives the data lines in response to the data signal DATA and the first control signal CONT1 from the timing controller 420. In an alternative exemplary embodiment, the data driver integrated circuits 460 may be directly mounted on the display panel 410 without being mounted on the circuit board 415.

The first and second gate driving circuits 430 and 470 and the data driving integrated circuits 450 are arranged in a side portion of the display panel 410 along the first direction X1. The first and second gate driving circuits 430 and 470 are disposed at opposing sides of the data driver integrated circuits 450, and the data driver integrated circuits 450 are arranged between the first and second gate driving circuits 430 and 470. In one exemplary embodiment, for example, the first gate driver circuit 430 is disposed at a left side of the data driving circuits 450 and the second gate driver circuit 470 is disposed at a right side of the data driving circuits 450.

The first and second gate driving circuits 430 and 470 may be configured to include the TCP or the COF, and gate driver integrated circuits 440 and 480 are mounted on the first and second gate driving circuits 430 and 470, respectively. The first gate driver integrated circuit 440 drives odd-numbered gate lines, e.g., a first gate line G1, a third gate line G3, . . . , an (i−1)-th gate line Gi−1, in response to the second control signal CONT2 from the timing controller 420. The second gate driver integrated circuit 480 drives even-numbered gate lines, a second gate line G2, a fourth gate line G4, . . . , an i-th gate line G1, in response to the third control signal CONT3 from the timing controller 420.

In an exemplary embodiment of the display device 400, as shown in FIG. 4, each of the gate lines, e.g., each of the first to i-th gate lines G1 to Gi, is branched to three main gate lines, and each of the main gate lines MG1 to MGn is connected to a corresponding sub-gate line of the sub-gate lines SG1 to SGn. In such an embodiment, "n" is obtained by multiplying "i" by 3. In such an embodiment, since three sub-gate lines are driven by using one gate line, the number of the gate lines G1 to Gi arranged in the non-display area NAR of the display panel 410 is one-third of the number of the sub-gate lines SG1 to SGn such that a width W1 of the left non-display area and a width W2 of the right non-display area of the display panel 410 are substantially reduced. As a result, a display having a substantially narrow bezel is effectively realized. In an exemplary embodiment, the bezel may be defined as a portion of a top chassis of the display device surrounding a display area AR. The configuration of the display panel 410 will be described in detail with reference to FIG. 5.

Figure 5:
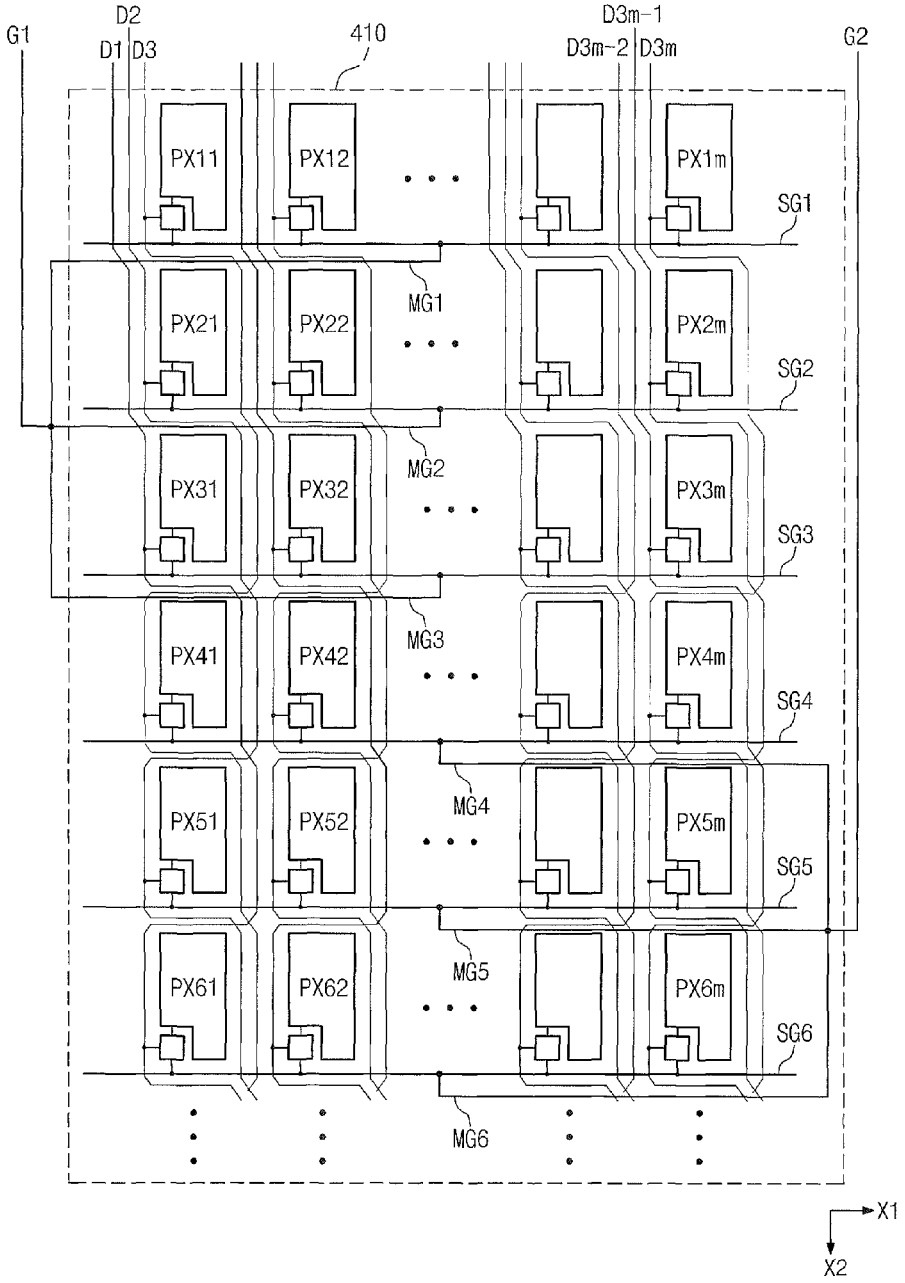
FIG. 5 is a block diagram showing an exemplary embodiment of pixels included in the display panel shown in FIG. 4.

FIG. 5 is a block diagram showing an exemplary embodiment of pixels included in the display panel shown in FIG. 4.

Referring to FIG. 5, one gate line, e.g., the first gate line G1, extending from the first gate driver integrated circuit 440 shown in FIG. 4 is connected to three main gate lines, e.g., the first to third main gate lines MG1 to MG3, extending in the first direction X1. The three main gate lines MG1 to MG3 correspond to three sub-gate lines, e.g., the first to third sub-gate lines SG1 to SG3. Each of the three main gate lines MG1 to MG3 is disposed adjacent to the corresponding sub-gate line of the sub-gate lines SG1 to SG3.

The three sub-gate lines connected to the one gate line are substantially simultaneously driven, and the pixels connected to the three sub-gate lines are connected to different data lines and applied with different data signals. In one exemplary embodiment, for example, the pixels PX11, PX21 and PX31, which are connected to a gate line, e.g., the first gate line G1, are driven in response to the gate driving signal provided through the gate line G1, and the pixels PX11, PX21 and PX31 are connected to different data lines from each other. In such an embodiment, the pixel PX11 may be connected to the third data line D3, the pixel PX21 may be connected to the second data line D2, and the pixel PX31 may be connected to the first data line D1 such that the number of the pixels connected to the one sub-gate line is m, 3×m data lines are provided.

An end of each of the three main gate lines MG1 to MG3 branched from the first gate line G1 is electrically connected to a center portion of a corresponding sub-gate line of the sub-gate lines SG1 to SG3 in the first direction X1. An end of each of the main gate lines MG4 to MG6 branched from the second gate line G2 is electrically connected to a center portion of a corresponding sub-gate line of the sub-gate lines SG4 to SG6 in the first direction X1. In such an embodiment of the display panel 410, the gate driving signals applied to the pixels adjacent to each other in the second direction X2 have substantially the same delay time. In one exemplary embodiment, for example, the delay times of the gate driving signals respectively applied to the pixels PX11 to PX61 adjacent to each other in the second direction X2 are substantially the same as each other. In such an embodiment, the delay times of the gate driving signals respectively applied to the pixels PX1m to PX6m adjacent to each other in the second direction X2 are substantially the same as each other. Therefore, although the number of the pixels arranged in one row substantially greater in the display panel 410 having a substantially large size and the sub-gate lines SG1 to SGn are substantially lengthened, a difference between the delay times of the gate driving signals transmitted to the pixels adjacent to each other is substantially decreased, and thus the horizontal line defect is effectively prevented from occurring.

FIGS. 6 to 13 are block diagrams showing exemplary embodiments of a display device according to the invention. In FIGS. 6 to 13, an arrangement and a connection relation of a gate line, a main gate line, and a sub-gate line will be mainly described. In addition, in FIGS. 6 to 13, any repetitive detailed descriptions of the same elements as those in FIG. 4 will be omitted for convenience of description.

Figure 6:
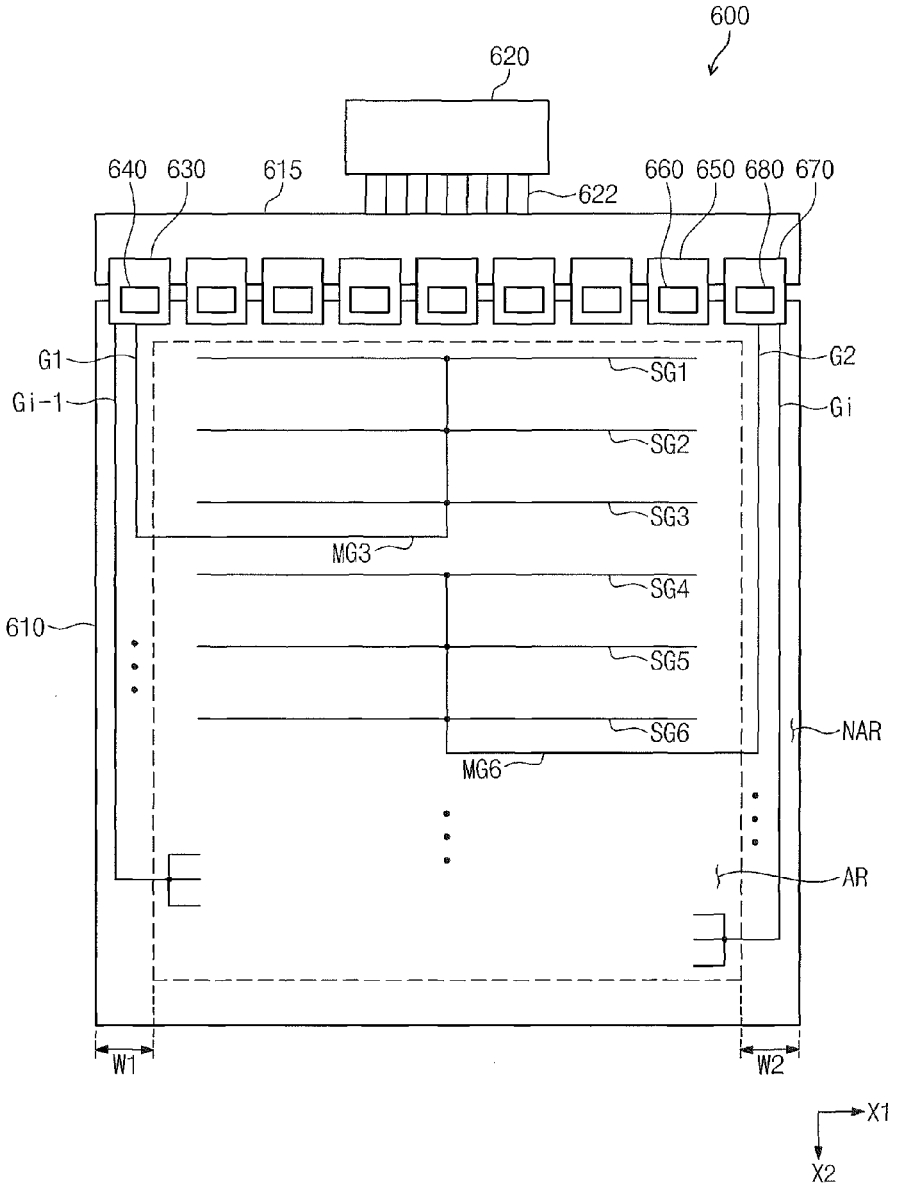
FIGS. 6 to 13 are block diagrams showing alternative exemplary embodiments of a display device according to the invention.

Referring to FIG. 6, three sub-gate lines adjacent to each other may be directly connected to one gate line. In one exemplary embodiment, for instance, the first to third sub-gate lines SG1 to SG3 are connected to the first gate line G1 and the fourth to sixth sub-gate lines SG4 to SG6 are connected to the second gate line G2. The first gate line G1 extends in a second direction X2 from a center portion of the display panel 610 to connect the first to third sub-gate lines SG1 to SG3 to each other. Similarly, the second gate line G2 is extended in a second direction X2 from a center portion of the display panel 610 to connect the fourth to sixth sub-gate lines SG4 to SG6 to each other. The circuit board 615, the timing controller 620, the cable 622, the gate and data driving circuits including integrated circuits 630 to 680 in FIG. 6 are substantially the same as those shown in FIG. 4, and any repetitive detailed description thereof will be omitted.

Figure 7:
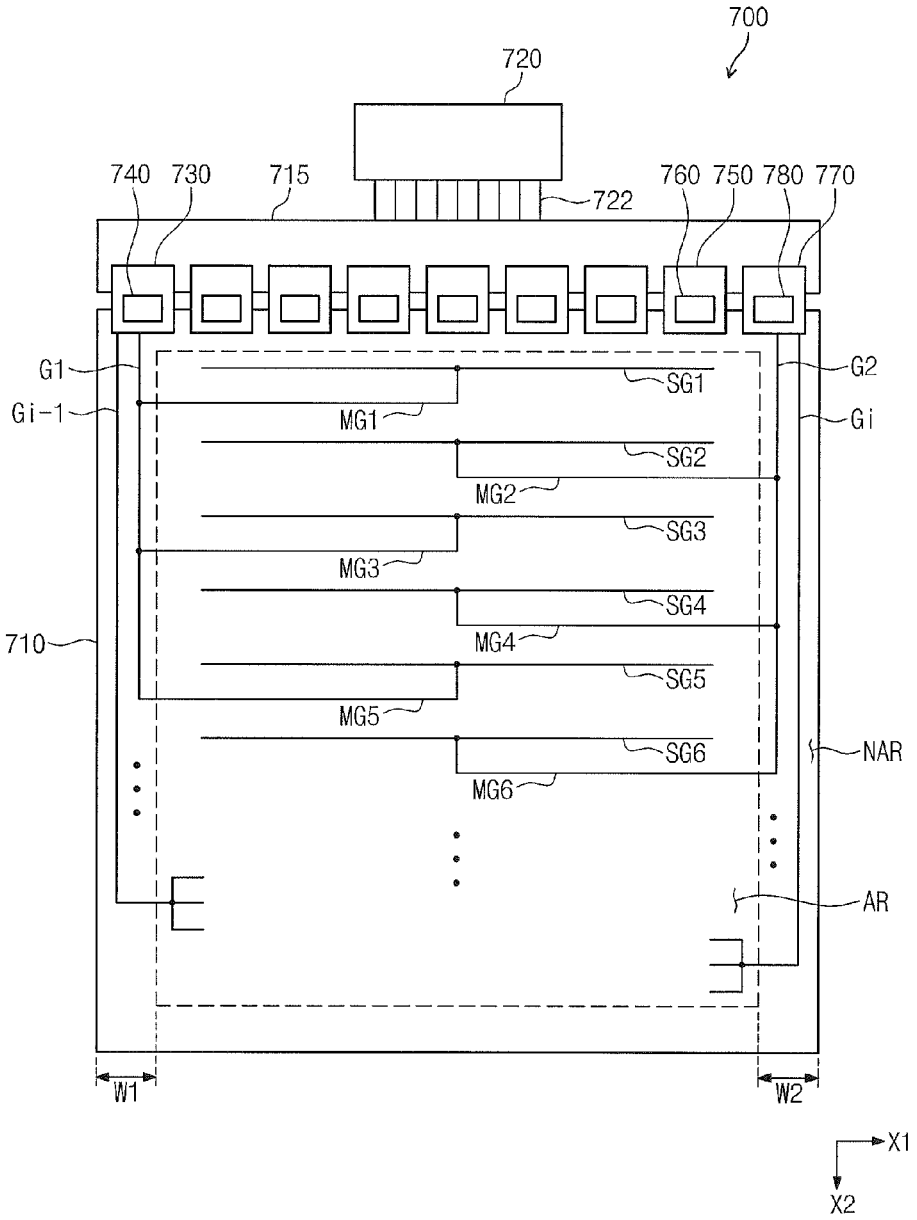

Referring to FIG. 7, in the display panel 710, each of the gate lines G1 to Gi may include three main gate lines branched off in the first direction X1. In one exemplary embodiment, for example, the first gate line G1 branches off to three odd-numbered main gate lines, e.g., the first, third and fifth main gate lines MG1, MG3 and MG5, and the second gate line G2 branches off to three even-numbered main gate lines, e.g., the second, fourth and sixth main gate lines MG2, MG4 and MG6. Each of the main gate lines MG1, MG3, . . . , and MGn-1 branched from the odd numbered gate lines G1 to Gi−1 connected to a first gate driving integrated circuit 740 are electrically connected to a corresponding odd-numbered sub-gate lines SG1, SG3, . . . , and SGn-1, and each of the main gate lines MG2, MG4, . . . , and MGn branched from the even numbered gate lines G2 to G1 connected to a second gate driving integrated circuit 780 are electrically connected to a corresponding even-numbered sub-gate lines SG2, SG4, . . . , and SGn. The circuit board 715, the timing controller 720, the cable 722, the gate and data driving circuits including integrated circuits 730 to 780 in FIG. 7 are substantially the same as those shown in FIG. 4, and any repetitive detailed description thereof will be omitted.

Figure 8:
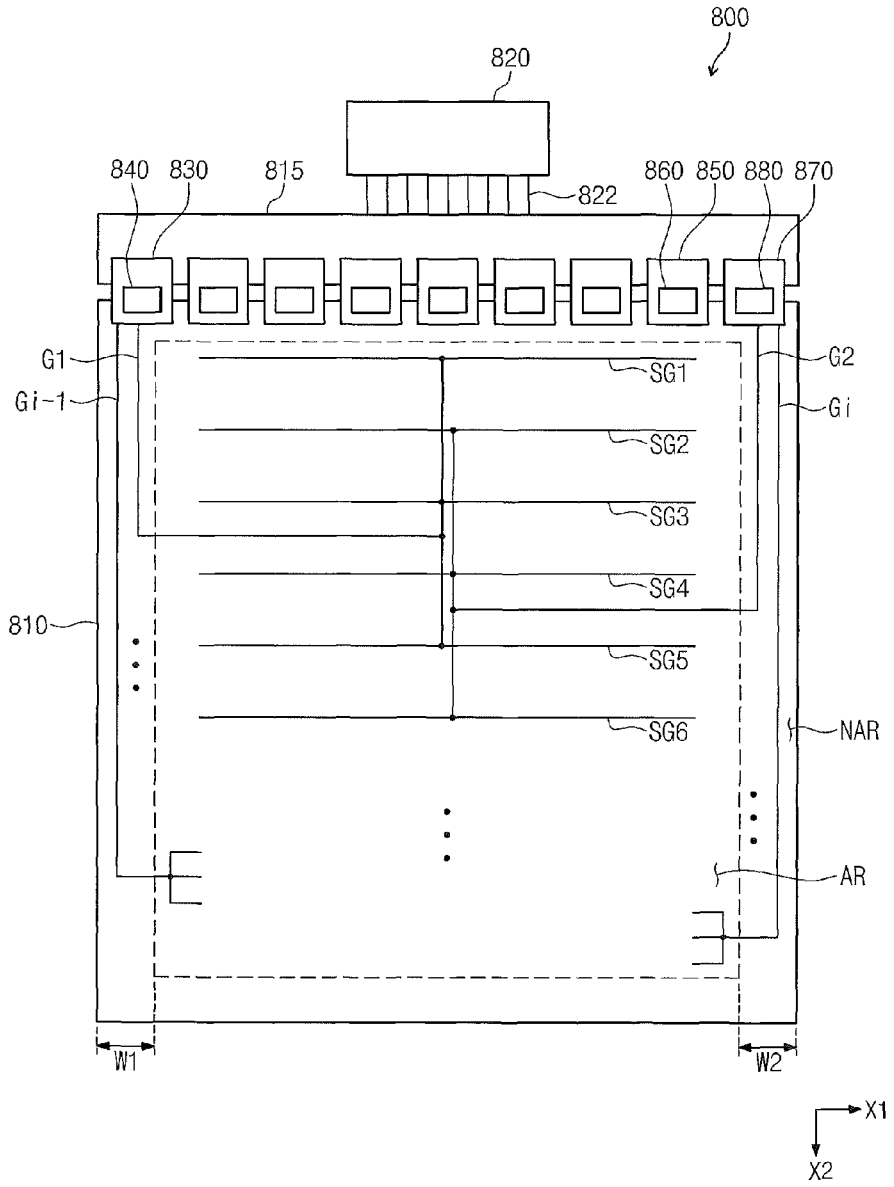

Referring to FIG. 8, each of gate lines G1 to Gi−1 connected to a first gate driving integrated circuit 840 may be electrically connected to three sub-gate lines of odd-numbered sub-gate lines SG1, SG3, . . . , and SGn-1. Each of gate lines G2 to G1 connected to a second gate driving integrated circuit 880 may be electrically connected to three sub-gate lines of even-numbered sub-gate lines SG2, SG4, . . . , and SGn. In one exemplary embodiment, for example, the first gate line G1 extends in a second direction X2 from a center portion of a display panel 810 and connected to three odd-numbered sub-gate lines, e.g., the first, third and fifth sub-gate lines SG1, SG3 and SG5. The gate line G2 extends in the second direction X2 from a center portion of the display panel 810 and connected to three even-numbered sub-gate lines, e.g., the second, fourth and sixth sub-gate lines SG2, SG4 and SG6. The circuit board 815, the timing controller 820, the cable 822, the gate and data driving circuits including integrated circuits 830 to 880 in FIG. 8 are substantially the same as those shown in FIG. 4, and any repetitive detailed description thereof will be omitted.

Figure 9:
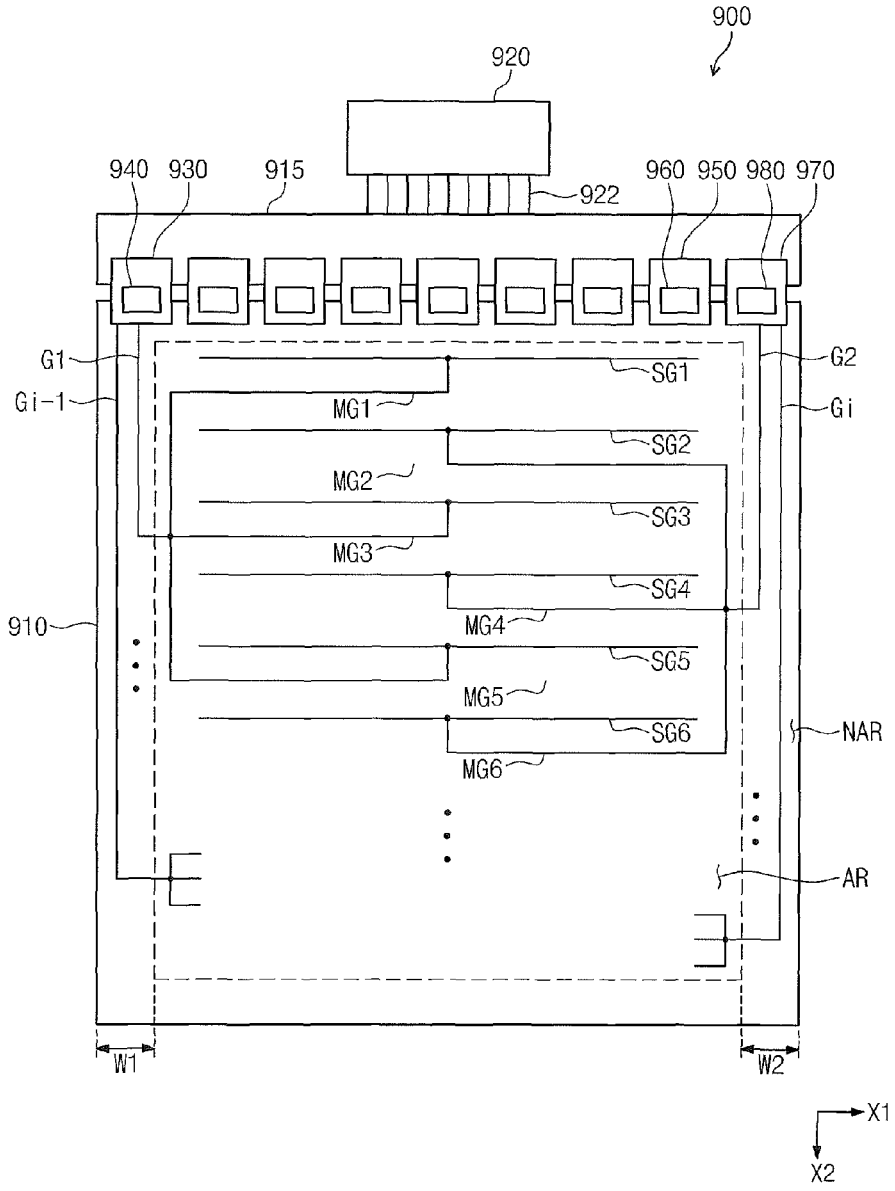

Referring to FIG. 9, in the display panel 910, each of gate lines G1 to Gi may include three main gate lines branched off in the first direction X1 from an end terminal thereof. In one exemplary embodiment, for example, the first gate line G1 branches off to the first, third and fifth main gate lines MG1, MG3 and MG5, and the second gate line G2 branches off to the second, fourth and sixth main gate lines MG2, MG4 and MG6. The odd-numbered main gate lines MG1, MG3, . . . , and MGn-1 branched from the end terminals of the odd numbered gate lines G1 to Gi−1 connected to the first gate driving integrated circuit 940 are electrically connected to corresponding odd-numbered sub-gate line SG1, SG3, . . . , and SGn-1, respectively. The main gate lines MG2, MG4, . . . , and MGn branched from the end terminals of the even-numbered gate lines G2 to G1 connected to the second gate driving integrated circuit 980 are electrically connected to corresponding even-numbered sub-gate line SG2, SG4, . . . , and SGn, respectively. The circuit board 915, the timing controller 920, the cable 922, the gate and data driving circuits including integrated circuits 930 to 980 in FIG. 9 are substantially the same as those shown in FIG. 4, and any repetitive detailed description thereof will be omitted.

Figure 10:
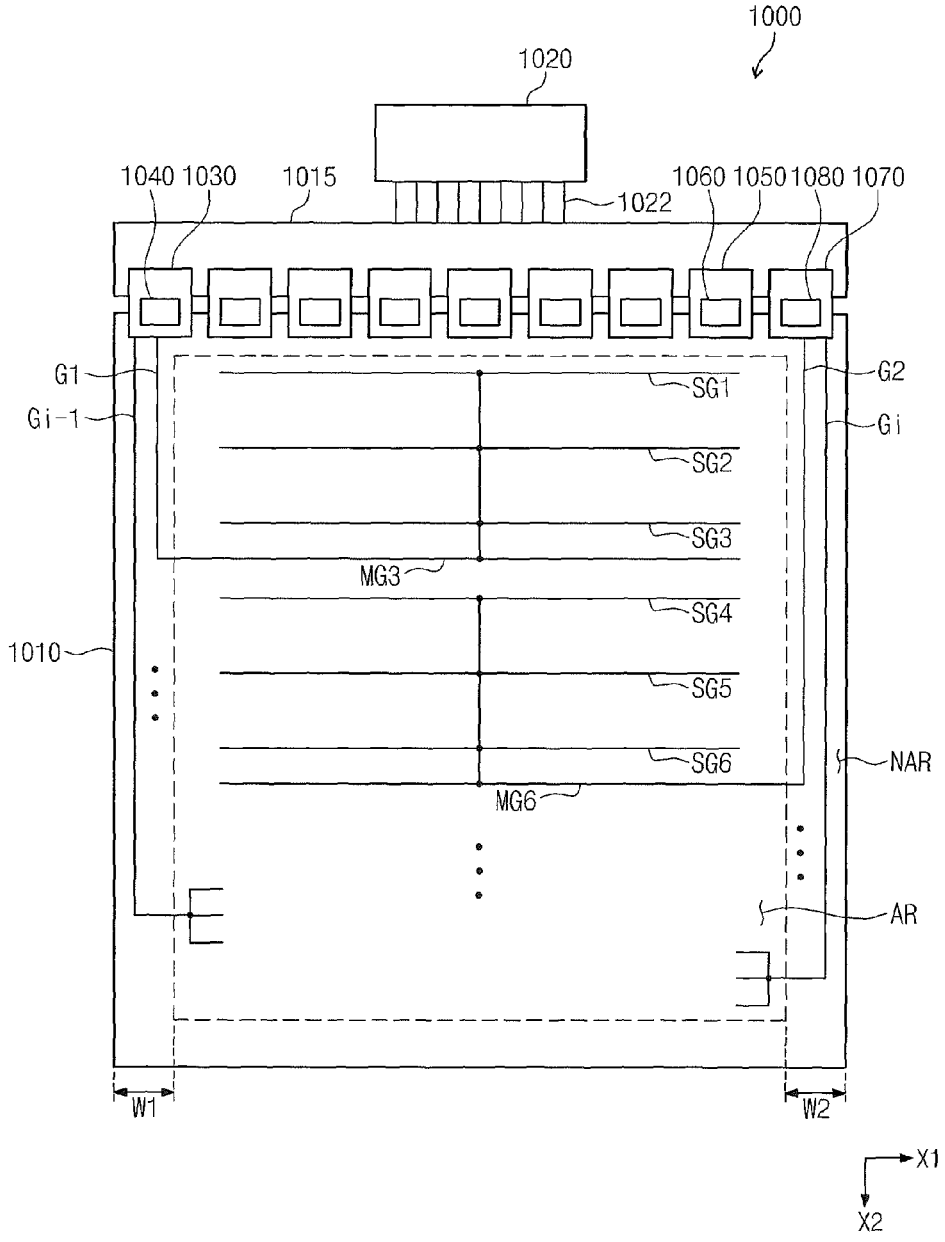

Referring to FIG. 10, the connection relation between the gate lines G1 to Gi and the sub-gate lines SG1 to SGn in a display device 1000 is substantially similar to the connection relation between the gate lines G1 to Gi and the sub-gate lines SG1 to SGn of the display device 600 shown in FIG. 6.

However, while the gate lines G1 to Gi of the display device 600 shown in FIG. 6 extend to the center portion of the display area AR in the first direction X1, the gate lines G1 to Gi of the display device 1000 shown in FIG. 10 extend to the end of the display area AR. In such an embodiment, an aperture ratio of a display panel 1010 may be substantially uniform throughout substantially an entire of the display area AR. The circuit board 1015, the timing controller 1020, the cable 1022, the gate and data driving circuits including integrated circuits 1030 to 1080 in FIG. 10 are substantially the same as those shown in FIG. 4, and any repetitive detailed description thereof will be omitted.

Figure 11:
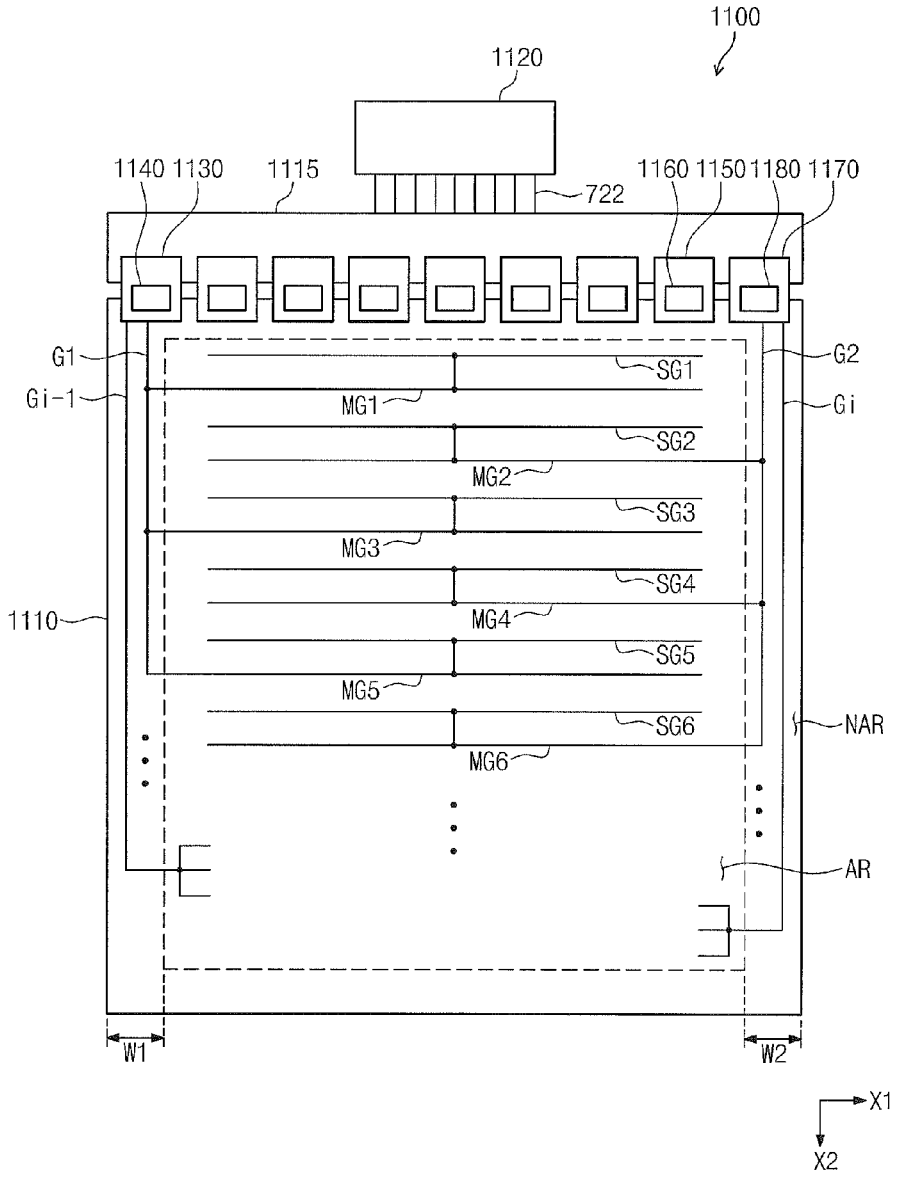
Figure 12:
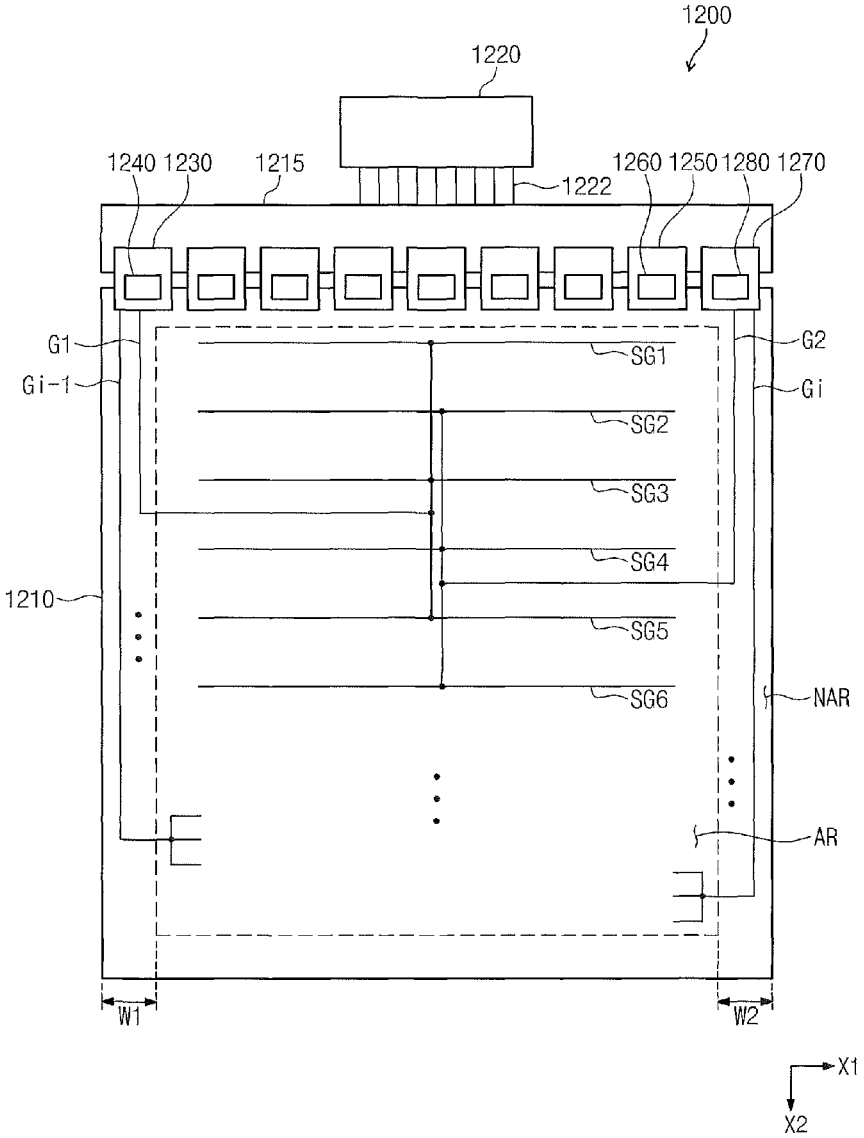
Figure 13:
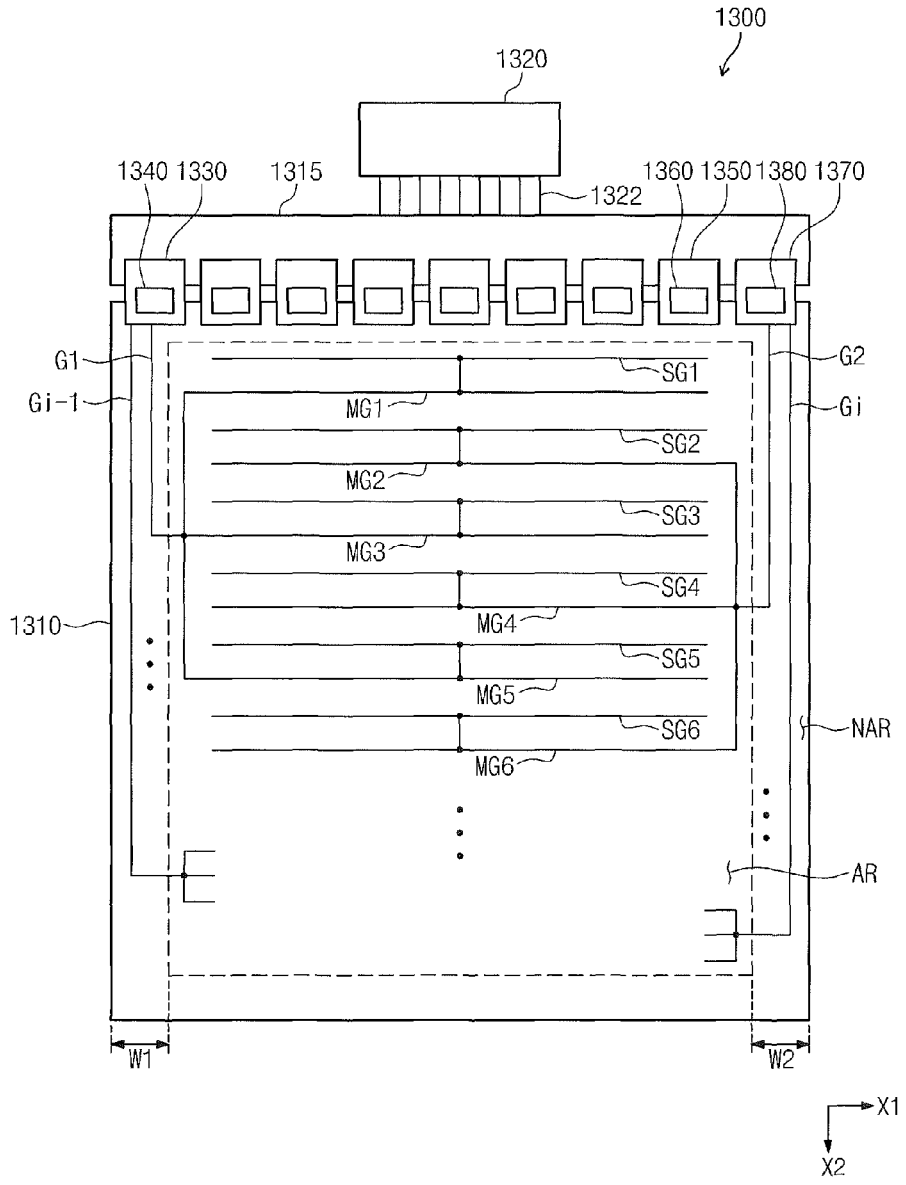

Similar to the display device 1000 shown in FIG. 10, the connection relation between gate lines G1 to Gi and sub-gate lines SG1 to SGn of display devices 1100 to 1300 shown in FIGS. 11 to 13 is substantially similar to the connection relation between the gate lines G1 to Gi and the sub-gate lines SG1 to SGn of the display devices 700, 800 and 900 shown in FIGS. 7 to 9. However, while the gate lines G1 to Gi of the display devices 700, 800 and 900 shown in FIGS. 7 to 9 extend to the center portion of the display area AR in the first direction X1, the gate lines G1 to Gi of the display devices 1100, 1200 and 1300 shown in FIGS. 11 to 13 extend to the end of the display area AR. In such an embodiment, each of the gate lines G1 to Gn may have a length substantially equal to a length of the corresponding sub-gate line of the sub-gate lines SG1 to SGn in the display area AR, that is, a portion of each of the gate lines in the display area AR, e.g., the corresponding main gate line, has a length substantially equal to a length of the corresponding sub-gate line of the sub-gate lines SG1 to SGn. Accordingly, an aperture ratio of a display panel 1010 is substantially uniform throughout substantially an entire of the display area AR. The circuit boards 1115, 1215 and 1315, the timing controllers 1120, 1220 and 1320, the cables 1122, 1222 and 1322, the gate and data driving circuits including integrated circuits 1130 to 1180, 1230 to 1280 and 1330 to 1380 in FIGS. 11 to 13 are substantially the same as those shown in FIG. 4, and any repetitive detailed description thereof will be omitted.

In the exemplary embodiments shown in FIGS. 4 to 13, one gate lines is connected to three sub-gate lines, but the invention is not limited thereto or thereby. In an alternative exemplary embodiment, one gate line may be connected two or more sub-gate lines.

The invention should not be construed as being limited to the exemplary embodiments set forth herein. Rather, these exemplary embodiments are provided so that this disclosure will be thorough and complete and will fully convey the concept of the invention to those skilled in the art. For example, an exemplary embodiment of a method of manufacturing a display device according to the invention includes providing a plurality of gate lines on a display panel of the display device, wherein the plurality of gate lines extends from a gate driver of the display device substantially in a first direction, providing a plurality of data lines on the display panel, wherein the plurality of data lines extends from a data driver of the display device substantially in a second direction, providing a plurality of sub-gate lines corresponding to the plurality of gate lines, respectively, and extending in the first direction on the display panel, wherein each of the plurality of sub-gate lines is disposed adjacent to a corresponding gate line of the plurality of gate lines, and providing a plurality of pixels in a display area of the display panel, where an end of each of the plurality of gate lines, which extends from the gate driver in the first direction, is electrically connected to a center portion of a corresponding sub-gate line in the first direction.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A display device comprising:

a plurality of gate lines extending substantially in a first direction;

a plurality of data lines extending substantially in a second direction;

a plurality of sub-gate lines corresponding to the plurality of gate lines and extending in the first direction, wherein each of the plurality of sub-gate lines is disposed adjacent to a corresponding gate line of the plurality of gate lines;

a gate driver configured to drive the plurality of gate lines;

a data driver configured to drive the plurality of data lines; and a plurality of pixels arranged in a display area, wherein an end of each of the plurality of gate lines, which extends from the gate driver in the first direction, is electrically connected to a center portion of a corresponding sub-gate line in the first direction, and wherein the center portion of the corresponding sub-gate line is disposed in a center portion of the display.

2. The display device of claim 1, wherein the plurality of gate lines is in a one-to-one correspondence with the plurality of sub-gate lines.

3. The display device of claim 2, wherein the gate driver comprises:

a first gate driver disposed in a first side of the display area, wherein the first gate driver drives a first group of the plurality of gate lines; and a second gate driver disposed in a second side of the display area, which is opposite to the first side of the display area, and facing the first gate driver, wherein the second gate driver drives a second group of the plurality of gate lines.

4. The display device of claim 3, wherein an end of a gate line in the first group of the plurality of gate lines, which extends in the first direction from the first gate driver, is electrically connected to the center portion of the corresponding sub-gate line in the first direction, and an end of a gate line in the second group of the plurality of gate lines, which extends in an opposite direction to the first direction from the second gate driver, is electrically connected to the center portion of the corresponding sub-gate line in the first direction.

5. The display device of claim 4, wherein each of the plurality of gate lines has a length substantially equal to a length of the corresponding sub-gate line in the display area.

6. The display device of claim 1, wherein each of the plurality of gate lines corresponds to K sub-gate lines of the plurality of sub-gate lines, wherein K is a natural number greater than one.

7. The display device of claim 6, wherein the gate driver comprises:

a first gate driver configured to drive a first group of the plurality of gate lines; and a second gate driver configured to drive a second group of the plurality of gate lines.

8. The display device of claim 7, wherein the first and second gate drivers and the data driver are arranged in a side of the display area along the first direction, and the first and second gate drivers are disposed at opposing sides of the data driver.

9. The display device of claim 8, further comprising:

a plurality of main gate lines corresponding to the plurality of sub-gate lines, respectively, and extending in the first direction, wherein each of the plurality of main gate lines is adjacent to a corresponding sub-gate line, wherein the plurality of main gate lines are grouped into a first group and a second group, each of the plurality of main gate lines in the first group electrically connects an end of a corresponding gate line in the first group of the plurality of gate lines, which extends in the second direction from the first gate driver, to the K sub-gate lines corresponding thereto, and each of the plurality of main gate lines in the second group electrically connects an end of a corresponding gate line in the second group of the plurality of gate lines, which extends in the second direction from the second gate driver, to the K sub-gate lines corresponding thereto.

10. The display device of claim 9, wherein the K sub-gate lines are arranged adjacent to each other.

11. The display device of claim 9, wherein a gate line in the first group of the plurality of gate lines is connected to corresponding K sub-gate lines of odd-numbered sub-gate lines of the plurality of sub-gate lines through the corresponding main gate line, and a gate line in the second group of the plurality of gate lines is connected to corresponding K sub-gate lines of even-numbered sub-gate lines of the plurality of sub-gate lines through the corresponding main gate line.

12. The display device of claim 9, wherein each of the plurality of main gate lines is disposed substantially parallel to the corresponding sub-gate line, and each of the plurality of main gate lines has a length substantially equal to a length of the corresponding sub-gate line in the first direction.

13. A method of manufacturing a display device, the method comprising:

providing a plurality of gate lines on a display panel of the display device, wherein the plurality of gate lines extends from a gate driver of the display device substantially in a first direction;

providing a plurality of data lines on the display panel, wherein the plurality of data lines extends from a data driver of the display device substantially in a second direction;

providing a plurality of sub-gate lines corresponding to the plurality of gate lines and extending in the first direction on the display panel, wherein each of the plurality of sub-gate lines is disposed adjacent to a corresponding gate line of the plurality of gate lines; and providing a plurality of pixels in a display area of the display panel, wherein an end of each of the plurality of gate lines, which extends from the gate driver in the first direction, is electrically connected to a center portion of a corresponding sub-gate line in the first direction, and wherein the center portion of the corresponding sub-gate line is disposed in a center portion of the display area.

* * * * *